US010290288B2

(12) United States Patent
Hamaker

(10) Patent No.: US 10,290,288 B2
(45) Date of Patent: May 14, 2019

(54) DISPLAY SYSTEM

(71) Applicant: Eric Kenneth Hamaker, Cambridge (GB)

(72) Inventor: Eric Kenneth Hamaker, Cambridge (GB)

(73) Assignee: DISPLAYLINK LIMITED (GB)

( * ) Notice: Subject to any disclaimer, the term of this patent is extended or adjusted under 35 U.S.C. 154(b) by 0 days.

(21) Appl. No.: 15/106,201

(22) PCT Filed: Nov. 26, 2014

(86) PCT No.: PCT/GB2014/053502
§ 371 (c)(1),
(2) Date: Jun. 17, 2016

(87) PCT Pub. No.: WO2015/092356
PCT Pub. Date: Jun. 25, 2015

(65) Prior Publication Data

US 2016/0351172 A1 Dec. 1, 2016

(30) Foreign Application Priority Data

Dec. 18, 2013 (GB) ..... 1322449.8

(51) Int. Cl.
*G09G 5/00* (2006.01)
*G09G 5/377* (2006.01)
*G09G 5/393* (2006.01)

(52) U.S. Cl.
CPC ..... *G09G 5/377* (2013.01); *G09G 5/005* (2013.01); *G09G 5/393* (2013.01);
(Continued)

(58) Field of Classification Search
CPC .... G09G 5/377; G09G 5/005; G09G 2310/04; G09G 2350/00; G09G 2360/127; G09G 2360/02; G09G 2370/20
(Continued)

(56) References Cited

U.S. PATENT DOCUMENTS 5,991,515 A * 11/1999 Fall ..... G06T 9/00 358/1.12
6,057,860 A * 5/2000 Hoffert ..... G06F 13/4291 345/10
(Continued)

FOREIGN PATENT DOCUMENTS

JP 2007214659 A 8/2007
WO 9620470 A1 7/1996
WO 0131416 A2 5/2001

OTHER PUBLICATIONS

Search Report for GB Appl. No. 1322449.8 dated Jun. 20, 2014, 4 pages.
(Continued)

*Primary Examiner* — Sarah Lhymn
(74) *Attorney, Agent, or Firm* — Fernando & Partners, LLP; Bejan Hefezzadeh

(57) ABSTRACT

A display system for displaying images includes an image compositor which receives image tiles from different application engines independently from each other and combines them into one or more combined image tiles in which the received image tiles are combined according to information indicating how the received image tiles are to be combined and located in the final displayed image, and a monitor for displaying the final displayed image, wherein different portions of the monitor are refreshed at different refresh rates, as the combined image tiles are received from the image compositor.

17 Claims, 5 Drawing Sheets

(52) U.S. Cl.
CPC ..... *G09G 2310/04* (2013.01); *G09G 2340/12* (2013.01); *G09G 2350/00* (2013.01); *G09G 2360/02* (2013.01); *G09G 2360/127* (2013.01); *G09G 2370/20* (2013.01)

(58) Field of Classification Search
USPC ..... 345/619, 629, 630, 631, 634, 635, 636, 345/637, 638, 641
See application file for complete search history.

(56) References Cited

U.S. PATENT DOCUMENTS

| | | | | |
|---|---|---|---|---|
| 6,724,403 | B1 | 4/2004 | Santoro et al. | |
| 2002/0101396 | A1 | 8/2002 | Huston et al. | |
| 2003/0020671 | A1 | 1/2003 | Santoro et al. | |
| 2005/0057552 | A1 | 3/2005 | Foo et al. | |
| 2005/0270299 | A1* | 12/2005 | Rasmussen | G01C 21/32 345/552 |
| 2008/0181498 | A1* | 7/2008 | Swenson | G09G 5/14 382/173 |
| 2009/0132942 | A1 | 5/2009 | Santoro et al. | |
| 2011/0074800 | A1* | 3/2011 | Stevens | G06T 11/40 345/545 |
| 2011/0187696 | A1 | 8/2011 | Slack et al. | |
| 2012/0162238 | A1 | 6/2012 | Fleck et al. | |
| 2012/0162266 | A1 | 6/2012 | Douglas et al. | |
| 2013/0088485 | A1* | 4/2013 | Chapman | H04N 19/88 345/419 |
| 2013/0159874 | A1 | 6/2013 | Bhogal et al. | |

OTHER PUBLICATIONS

Search Report for GB Appl. No. 1322449.8 dated May 2, 2015, 2 pages.
Search Report for GB Appl. No. 1322449.8 dated May 2, 2015, 3 pages.
International Search Report for PCT/GB2014/053502 dated Feb. 20, 2015.
Written Opinion for PCT/GB2014/053502 dated Feb. 20, 2015.

* cited by examiner

DISPLAY SYSTEM

RELATED APPLICATIONS

This application claims the benefit of International Patent Application No. PCT/GB2014/053502, filed on Nov. 26, 2014, and Great Britain Patent Application No. GB1322449.8, filed Dec. 18, 2013, both of which are incorporated by reference herein.

FIELD OF INVENTION

This invention relates to a display system, particularly, to a display system having a display monitor coupled to a computer and arranged to display images that are generated and controlled by the computer.

BACKGROUND

It is intended that the term "computer" includes all processor controlled devices, which may be various portable devices, such as laptop computers, tablets, smart phones or other portable devices, as well as desktop and other less portable computing devices. The desktop and other computing devices are coupled to a separate display monitor. Many portable devices, as well as having an integrated display screen, can also be coupled to such a separate display monitor, as well as to local displays.

In the past, display monitors were formed by cathode ray tubes, in which a display signal was rastered across the screen line by line. In other words, a single electron beam was scanned from one side of the screen to the other to form a line of the display. The beam was then returned to the first side of the screen and scanned across to form the next line of the display, and so on. Therefore, the display signals that were generated by the computer for display, were in raster format, providing each line, one at a time. As display monitors evolved to flat screen LCD, OLED and other display technologies, the display signals remained in raster format, partly for backward compatibility and partly because the monitors were designed to display such raster signals.

Many of the newer monitors are formed, however, by pixel groups (of RGB pixels) that are addressable using row and column addressing, so that each pixel group is individually addressable. Nevertheless, the incoming display signals are still provided by the computer device in raster format, whether compressed or not, and the monitor then processes the raster display signal to be displayed on the monitor.

Therefore, an image is displayed on the monitor by controlling the display for all the pixel groups in a line for all the lines, in turn. The image is therefore refreshed each time the monitor displays all the new lines of the image. This is normally done at 60 Frames Per Second (FPS) whether or not the image changed as that is the rate that was required for smooth display on electron beam based displays.

When several different applications are operating at once, for example, when different windows are open at once in a computer system, there may be several different images, for example, a text document, a picture, web browser with text and still and/or moving images, and perhaps a movie, all open in windows that need to be shown and refreshed in a single "image" shown on the display at the same time. Each application generates its own output and an image compositor takes each of those outputs and uses them to form a combined image according to the positions of the windows to be displayed on the monitor. The combined image is updated and stored in a frame buffer and the stored complete image is then transported to the monitor and displayed on the screen by taking all the image data on a line-by-line basis from the frame buffer and displaying them in a rastered manner.

BRIEF SUMMARY OF THE INVENTION

The present invention therefore seeks to provide a display system, and component parts thereof that is more efficient than the hitherto known systems.

Accordingly, in a first aspect, the invention provides an image compositor for generating image tiles for forming a final image for display on a monitor, the image compositor having a plurality of inputs for coupling to outputs of a plurality of application engines to receive one or more image tiles generated by the application engines, the image tiles from different application engines being received independently from each other and at independent rates, wherein the compositor comprises a processor for combining the received image tiles into one or more combined image tiles in which the received image tiles are combined according to information indicating how the received image tiles are to be combined and located in the final displayed image, the image compositor further comprising an output for outputting each combined image tile together with information indicating where the combined image tile is to be located in the final displayed image.

In a second aspect, the invention provides a display system for displaying an image on a monitor, the display system comprising an image compositor as described above, and a monitor for displaying the final displayed image, wherein the combined image tiles are provided by the image compositor for rendering on the monitor, wherein different portions of the monitor are refreshed at different refresh rates, as the combined image tiles are received from the image compositor.

In a preferred embodiment, the monitor comprises a plurality of pixels, each pixel being individually addressable and controllable, and a pixel memory for each pixel of the monitor for storing a power level for the respective pixel, wherein the pixel memories are updated according to the location of the corresponding pixel of the monitor and the refresh rate for that location of the monitor.

Preferably, only a portion of the monitor is refreshed at each update, wherein the portion of the image that is refreshed may comprise one or more image tiles, each image tile comprising a plurality of pixels.

The combined image tiles provided by the image compositor may be compressed prior to being transported to the monitor, and decompressed prior to being displayed at the monitor.

According to another aspect, the invention provides a display system for displaying an image on a monitor, the display system comprising an image tile generator for providing image tile updates, and a monitor for displaying a final image formed of a plurality of image tiles, wherein the final image is displayed on the monitor by refreshing different portions of the monitor at different rates according to the rate at which the image tile updates are provided by the image generator, wherein the refreshed portions of the final image may be located anywhere on the monitor.

In one embodiment, the monitor comprises a plurality of pixels, each pixel being individually addressable and controllable, and a pixel memory for each pixel on the monitor for storing a power level for the respective pixel, wherein the pixel memories are updated according to the location of the corresponding pixel on the monitor and the refresh rate for that portion of the image displayed on the monitor. The portions of the image that are refreshed may comprise one or more image tiles, each image tile comprising a plurality of pixels.

Preferably, the image tile updates that are received may update any portion of the image and the portions of the image that are refreshed are refreshed in any order, wherein a refresh rate of the monitor is independent from an update rate of a source of the image tile.

The image tile updates provided by the image tile generator may be compressed prior to being transported to the monitor, and decompressed prior to being displayed at the monitor.

According to a further aspect, the invention provides a method of displaying a final image on a monitor, the final image being formed of a plurality of image tiles, the monitor comprising a plurality of pixels, each pixel being individually addressable and controllable, and a pixel memory for each pixel on the monitor for storing a power level for the respective pixel, the method comprising: receiving an image tile update comprising display information for displaying an image tile on the monitor; determining a location of the image tile on the monitor; addressing one or more pixels displaying that image tile to control the pixel memories of the one or more pixels according to the display information to display that image tile, wherein successive image tile updates that are received may refresh any portion of the final image, whereby different portions of the final image may be refreshed at different rates.

Preferably, the pixel memories are updated according to the location of the corresponding pixel on the monitor and the refresh rate for that portion of the final image displayed on the monitor. The portions of the final image that are refreshed may comprise one or more image tiles, each image tile comprising a plurality of pixels.

The received image tile updates may be compressed and the method may further comprise decompressing the image tile updates prior to the addressing the one or more pixels.

In one embodiment, the method further comprises receiving image tiles generated by a plurality of application engines; and combining the received image tiles to produce the image tile updates according to information indicating how the received image tiles are to be combined and located in the final image.

Each of the application engines preferably generates the image tiles at a rate depending on an application being executed by the application engine.

The image tiles may be received directly from the plurality of application engines by an image compositor and the image tile updates may be sent directly from the image compositor to a transport mechanism for transporting the image tile updates to the monitor. The method may further comprise compressing, encrypting, and/or encoding the image tile updates prior to being transported to the monitor.

According to another aspect, the invention provides an application engine for executing an application to process data and to provide one or more image tiles for displaying the processed data, the application engine comprising a processor for processing the data and generating the image tiles for display, the processor updating the image tiles at an update rate according to the application being executed and independent of a refresh rate of a monitor on which the image tile is to be displayed.

The application may comprise any one of an application generating a video image, an application generating a 2D image, and an application generating a 3D image, so that, for example, a 2D image may be updated less frequently than a still image, and a 3D image may be updated less frequently than a video image.

BRIEF DESCRIPTION OF THE DRAWINGS

Embodiments of the invention will now be more fully described, by way of example, with reference to the drawings, of which.

DETAILED DESCRIPTION OF THE DRAWINGS

Figure 1:
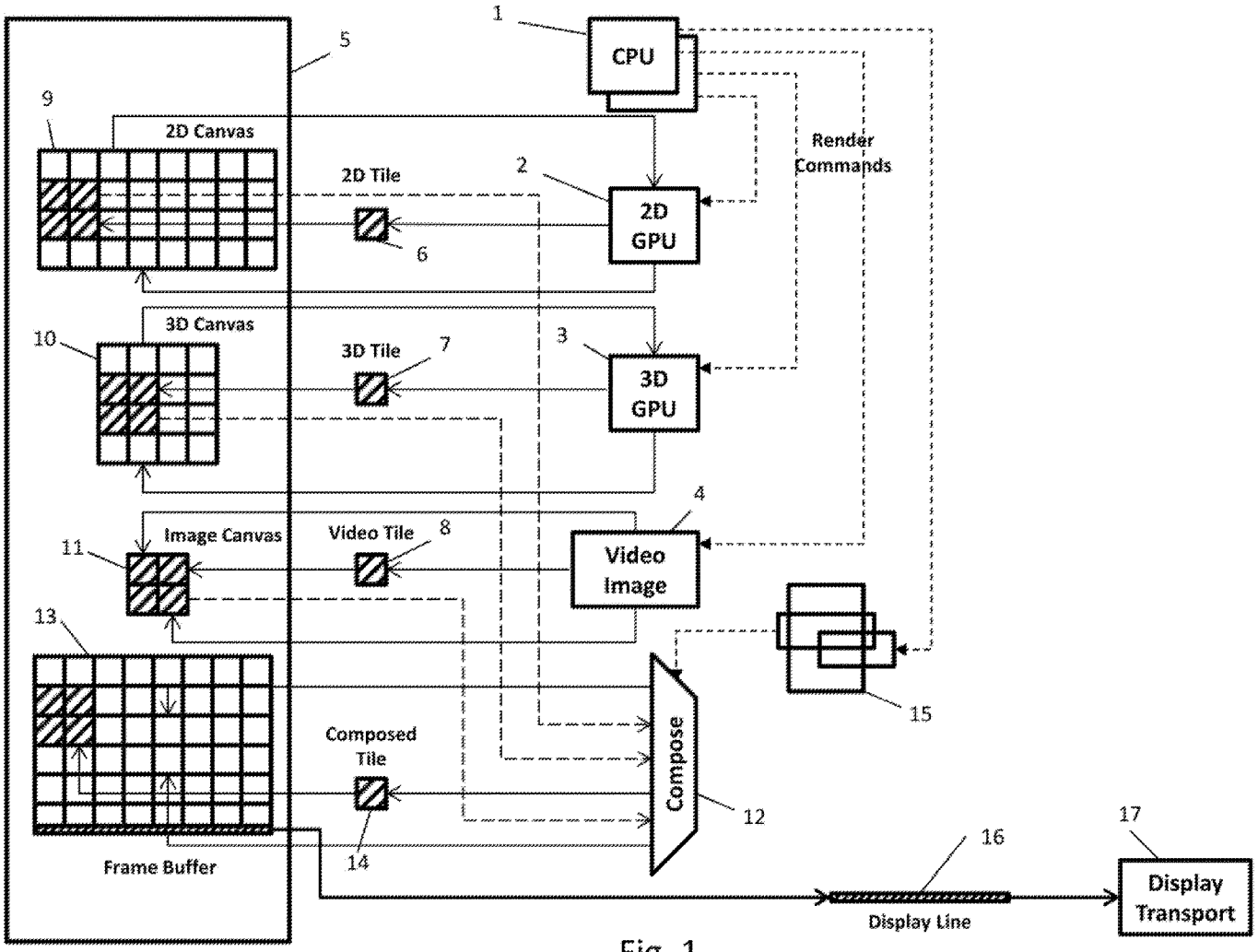
FIG. 1 shows a general schematic view of a known architecture for generating and compositing images for transporting to a raster-type monitor.

Thus, as shown in FIG. 1, a conventional architecture for generating and compositing images for transporting to a raster-type monitor includes several application engines, each producing image tiles that are rendered onto respective application canvases as they become available. Each application engine is optimized to generate image tiles according to the application it is executing. There are 4 (or more) basic types of media stored in such canvases:

2D Graphics and Text
3D Graphics
Image (Picture)
Video

All are generally optimally processed on an image tile basis. Image tiles are N×M sized subsets of canvas pixels and are rendered by software or hardware application engines one or more at a time and subsequently stored in their targeted canvas. Thus, as shown in FIG. 1, there may be a 2D application engine, embodied as a Graphics Processing Unit (GPU) 2, a 3D application engine 3, and a video imaging engine 4, all under the control of a Central Processing Unit (CPU) 1. The CPU 1 may provide control and data to the application engines, 2, 3 and 4, or enable data to be provided to the application engines. The data may, in some cases, be encoded and/or compressed when received by the application engines. In any event, the application engines process the data and generate image tiles, which for part of a complete image for that application that may be displayed. Each image tile is rendered in memory 5, such as DRAM memory, on a canvas for that application. Therefore, a 2D image tile 6, for example from a word processing application, is generated by the 2D application engine 2 and positioned at an appropriate location on a 2D canvas 9 in the memory 5. Similarly, a 3D image tile 7, for example from a gaming application, is generated by the 3D application engine 3 and positioned at an appropriate location on a 3D canvas 10 in the memory 5 and a video image tile 8, for example from a video application, is generated by the video application engine 4 and positioned at an appropriate location on a video canvas 11 in the memory 5. The application engines render these canvases at rates required by individual application constraints. Some, such as video, may update at rates of 24, 30 or 60 times per second. Others, such as 3D or 2D graphics may only update once every two seconds or, for still images or text, only once every other minute. Generally the rate is totally independent of the rate at which the display must be updated, and is dependent on the application being run and the speed of the application engine. Furthermore, the application engine may use previously rendered tiles in generating updated tiles or adjacent tiles.

A display monitor may only display portions of all the images rendered by the application engines, depending on the arrangement of the images on the final display image, for example, depending on the locations of different windows having different images, and their overlapping locations, if any. Therefore, in order to correctly render all the application images onto a final display image, an image compositor 12 takes the application images from the canvases 9, 10 and 11, and composites, or combines, them, on a tile-by-tile basis into a final image canvas, termed a frame buffer 13. The image compositor 12 is controlled using composition information 15 from the CPU 1, and may involve flipping, rotating, scaling, blending, or otherwise processing or combining portions of the images from the application canvases.

Thus, each composed image tile 14, may be an identical tile to one from one of the application canvases, 9, 10 or 11, although it may be positioned in a different location in the frame buffer from where it was in the application canvas, a part of a tile or a combination of tiles from a single application canvas or may be a combination of tiles from two or more images from two or more application canvases. The composed image tile 14 is then positioned in the frame buffer 13 at the appropriate location. The image compositor generally composes the final image at a rate determined by the rate at which the most frequently updated application canvas is updated, for example at 24 or 30 frames per second (fps) for video, but the composition rate may be determined based on some other rate, perhaps dependent on the rate at which the display monitor refreshes the display (usually 60 fps).

In any event, it will be appreciated that the frame buffer has a complete final display image and the full image is taken line-by-line 16 at a rate that may be the same as the composition rate to be transported to the display monitor over a transport mechanism 17, which may include over a network. This display data may be compressed prior to being transported. Such compression is often useful because of the large amount of display data that needs to be transported: the full display image taken from the frame buffer at rates that may be as high as 60 fps.

In general, an embodiment of the invention includes three tile or tile group process aligned parts:

An image production part

A display or panel part

A tile based transport

The Image Production part produces image updates on a tile or tile group basis at rates driven by application requirement. These tiles or tile groups are aligned directly or by multiples of the tile unit used to update the display. Normally, the Image Production part is the application host, a phone, tablet, PC, or other computing device that presents a visual display on a panel. For the purposes of this description, this host will provide the composition or rendering of any part of the final image that will be visible on the display and will produce and transport to the display that image as a multiple of display tile units. Optionally it may mask parts of those tiles that have not actually been rendered through the use of transparent pixels, for instance. Optimally it will compose/render these tile unit regions and immediately transmit them to the display without any need of any local intermediate storage to collect an entire display image (Frame Buffer).

The Display part receives these tile based updates and uses them to update the display on a tile unit basis. The display may also optionally store the tile units in a display side frame buffer for purposes of display refresh should that be needed. The display, which must periodically refresh, does so on a tile-by-tile based upon elapsed time from last update/refresh. These refresh tiles are stored in either a panel side frame buffer or in-panel memory. Pixels on a display are updated with pixel information from images assembled by an image generating host. Generally they are updated at a rate fast enough to deliver smooth transitions and no detectable flicker (or other artifacts). Traditionally these pixels are read line-by-line, top to bottom. Conventionally, this has been aligned with the AC power cycle period (60 Hz, in the US). This process is at odds, though, with the rate at which changes are actually produced by the host, which, for instance, may have no changes for extended periods of time, and the refresh rates required by the displays themselves.

When changes are available they naturally come in regions. In this embodiment, displays update just those regions as driven by the processes that generate them. Such displays will update by regions or by an integral number of tile update units that include those regions. Such displays will receive a set of pixel information representing a region or tile unit and directly update just those display pixels with it.

Actual refresh rates required by displays depend upon the technology they are implemented with. Some, for instance, only need their pixels to be refreshed once every second. Updating them 60 times a second, therefore, has little practicality. Updates naturally refresh the display and if done on a regional/tile update unit basis then the remaining pixels may be refreshed as required by image quality by reading them on a region or tile update unit basis from a local store either in the panel itself or in a memory associated with the panel and then refreshing the required pixels. If using associated memory then it is optimally located panel side of a display link but it could for some implementations be host side as well.

While the display described might be best (most efficiently, most effectively, and most easily) implemented using a fixed tile update unit size, it is also possible to do so on a variable region basis.

The tile based transport part on the host side receives tile or tile group units, optionally compresses them, packages them into transport packets and sends them to the display side. The display side unpacks these tiles/tile group units, optionally decompresses them, and hands them off for display update and/or storage for display refresh. To support the regional or tile based update process the transport mechanism in this embodiment is also aligned by transporting tiles, tile groups, or regions across the display link. It may do so with some overlap and or using some compression scheme to reduce the traffic and or energy used. The transport mechanism may align with the tile production process for optimal efficiency in transporting the tiles/regions as soon as they are produced. This reduces unneeded memory traffic, use of temporary storage resources, and updates display pixels as soon as possible.

Figure 2:
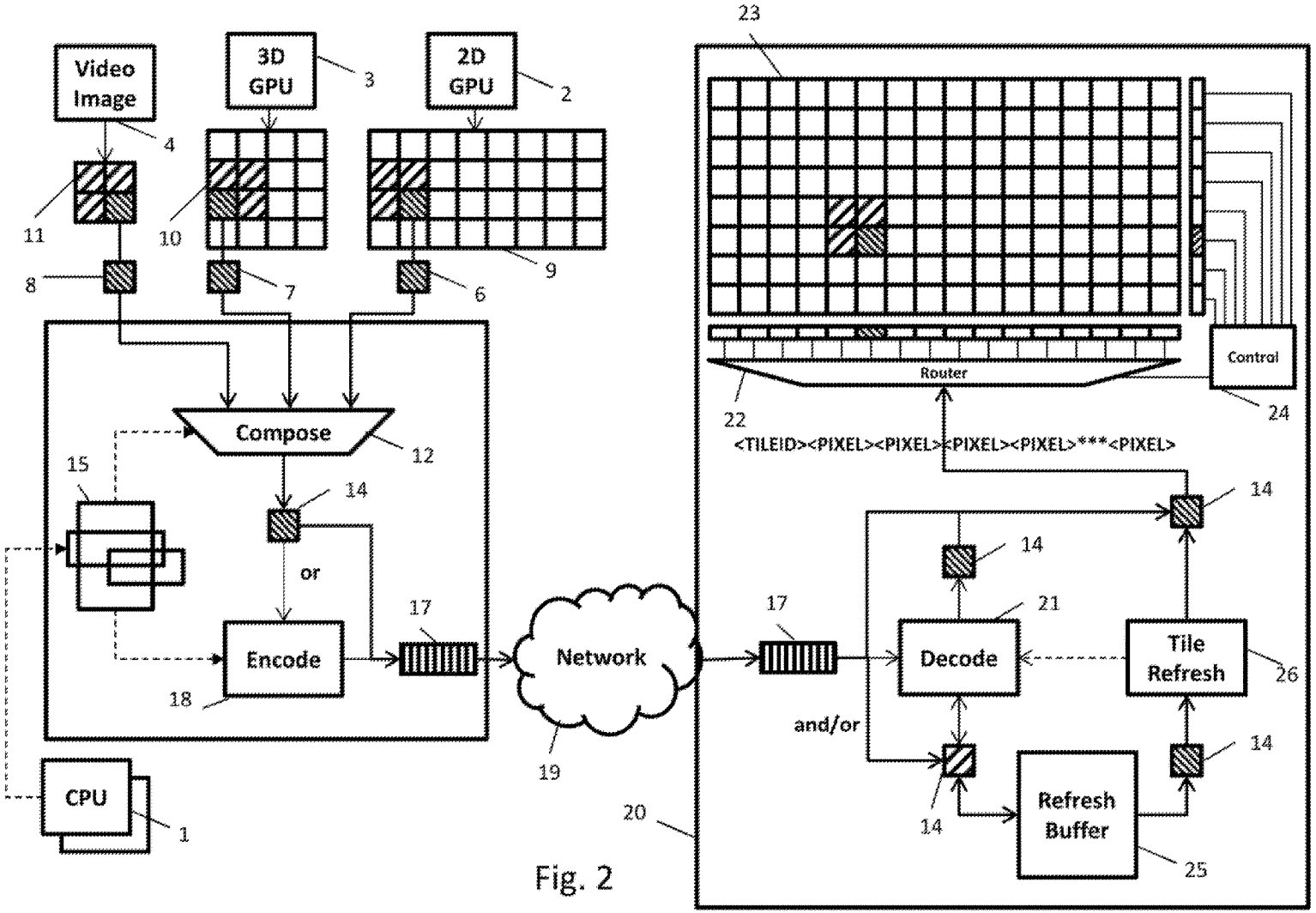
FIG. 2 shows an overview schematic view of a display system according to one embodiment of the present invention

Turning, then, to FIG. 2, there is shown a schematic overview of a display system according to one embodiment of the present invention. The same elements as in FIG. 1 are shown with the same reference numerals. Thus, a host device 18 includes the application engines 2, 3 and 4, which generate their respective images, which are rendered onto respective canvases 9, 10 and 11, in memory, as before. The image compositor 12 takes image tiles, for example, 6, 7 and 8, from the application canvases 9, 10 and 11, and combines them based on composition information 15 from the CPU 1 to produce the composed image tiles 14. However, instead of rendering the composed image tiles 14, as in the conventional system of FIG. 1, the composed image tile 14 is immediately sent to the display monitor, as soon as it has been generated by the image compositor 12. The composed image tile 14 may be encoded and/or compressed, for example by encoder 18, or may be sent without encoding or compression. In either case, the composed image tile 14 is sent to the transport mechanism 17. The transport mechanism 17 transports the composed image tiles either via a network 19, or directly, to a display monitor 20. The display monitor 20 receives the composed image tiles 14 from the transport mechanism 17. If the composed image tiles 14 have been encoded or compressed, then they are passed to a decoder 21, where they are decoded/decompressed. The decoded/decompressed composed image tiles 14 (or the composed image tiles as received from the transport mechanism 17 if they were not encoded/compressed) are then passed directly to a monitor router 22, which routes the composed image tiles directly to their location in the final image onto a display 23 of the monitor 20, under the control of a display controller 24. If necessary, or desirable, the composed image tiles 14 received from the transport mechanism may be stored in a refresh buffer 25, either in their raw, uncompressed form, or in an encoded/compressed state. If they are stored in the encoded/compressed state, a tile refresh controller 26 will need to send them to the encoder 21, when they are required for refreshing the display. It will be seen, therefore, that this embodiment of the invention recouples the update of regions of the display image/frame buffer with update of the display by directly rendering those regions to the display itself on a region or a multiple tile update unit basis. This enables a decoupling of refresh from update and brings with it an associated efficiency of reducing memory, link, and panel traffic. Updates and refresh are enabled to happen at rates native to the processes that produce them or demanded by the technology used to implement them.

Figure 3:
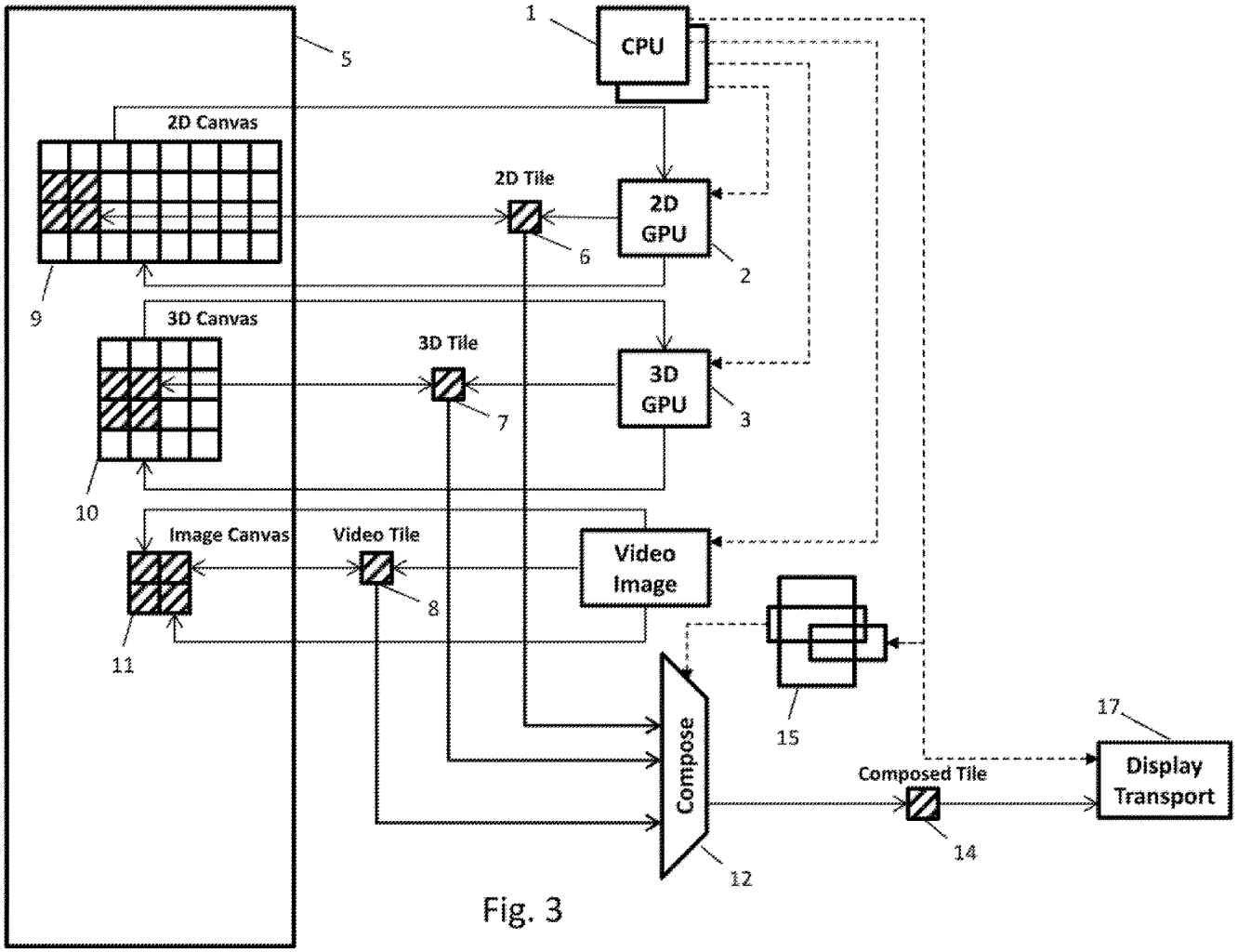
FIG. 3 shows a general schematic view of an architecture for generating and compositing images in the display system of FIG. 2.

FIG. 3 shows the architecture for generating and compositing images in the display system of FIG. 2 in a view analogous to that of the architecture of FIG. 1 to enable the differences to be better appreciated. The same elements have the same reference numerals as in FIG. 2. In this architecture, the CPU 1 provides control and data to the application engines 2, 3 and 4, or enables data to be provided to the application engines 2, 3 and 4, and the application engines 2, 3 and 4 process the data and generate image tiles 6, 7 and 8, which are rendered in memory 5 on application canvases 9, 10 and 11. In this case, however, the image compositor 12 may take the image tiles 6, 7 and 8 either directly from the application engines 2, 3 and 4, as they are produced, or from the canvases 9, 10 and 11, and the image compositor 12 composites them, on a tile-by-tile basis, into composed image tiles 14. The composed image tile 14 is then passed directly to the transport mechanism 17, together with location and other required information from the CPU 1.

If the image tiles 6, 7 and 8 generated by the application engines 2, 3 and 4 do not require further processing or combination, then they can be passed directly to the compositor, but if multi-canvas composition-blending is needed then overlapping tiles must be fetched from the appropriate canvas(es). If scaling of images is required, then, again images (or portions of the images) may need to be obtained from the canvas(es), depending on the scaler. Since only individual composed image tiles are being transported, however, only composition/tile position and tile pixels are needed to route the tiles to their destination. This results in reduced memory bandwidth, which delivers better CPU and image engine performance together with lower power requirements, and, since pixels can be optimally stored in and fetched from memory as tiles, this improves Read/Write efficiency and utilization.

Figure 4:
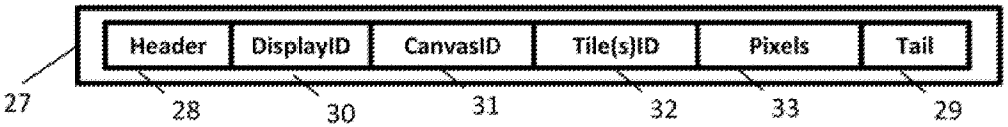
FIG. 4 shows an example of a transport packet that may be used for transporting a composed image tile in the display system of FIG. 2.

FIG. 4 shows an example of a transport packet 27 that may be used to transport the composed image tile 14 to the monitor 20. In this example, the packet has a header 28 and a tail 29, between which lies for the display identification information 30, identifying which monitor the packet is bound for, canvas identification information 31, identifying which canvas, i.e. which particular final image, the packet is providing information about, since packets may arrive in incorrect order at the monitor 20, tile identification information 32, indicating which tile in the image, i.e. the location of the tile in the final image, the packet is providing information about, and, finally, the actual pixel information 33 for each pixel in the tile to enable the pixels to be appropriately controlled. As mentioned, the composed image tiles, may be compressed or uncompressed prior to transportation, and the composed image tiles may be transported in optimally aggregated groups. It will be seen, therefore, that only sending composed image tiles to the monitor rather than complete frame buffers greatly saves on traffic bandwidth.

Figure 5:
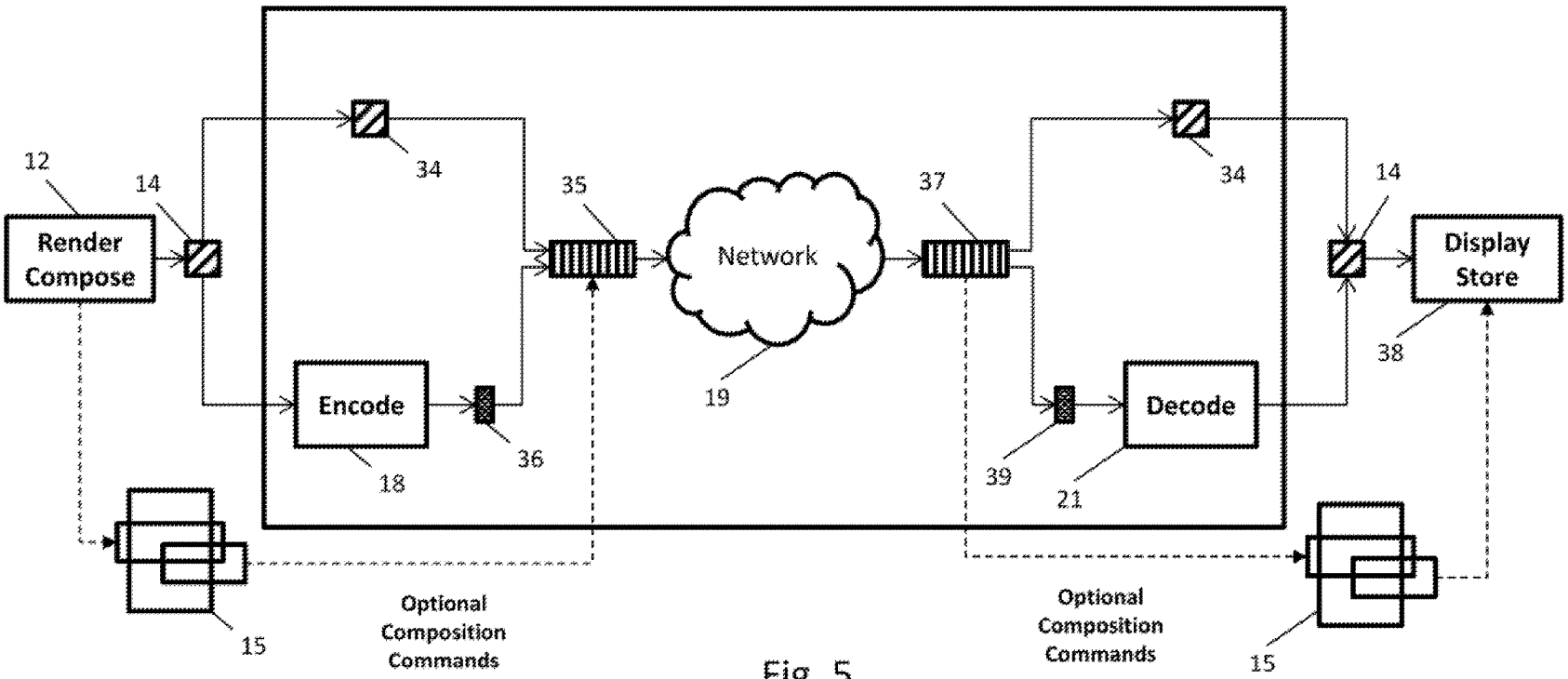
FIG. 5 shows a general schematic view of an architecture for transporting image tiles in the display system of FIG. 2.

As shown in FIG. 5, therefore, the composed image tiles 14 from the image compositor 12 may be sent via the transport mechanism 17 either as RAW composed image tiles 34 to be encapsulated into packets according to a desired protocol in a packetizer 35, or may first be encoded/compressed in the encoder 18 to produce compressed composed image tiles 36, which are then encapsulated by the packetizer 35. After being passed through the network 19 by the transport mechanism 17, the received packets are decapsulated by de-packetizer 37, and the composed image tiles 14 (either the RAW composed image tiles 34, or, if compressed composed image tiles 39 were initially received, decoded/decompressed composed image tiles which have been decoded/decompressed by decoder 21) are sent either directly to be displayed and/or to be stored in the refresh buffer or other display store 38. It is also possible for the composition information 15 to be transported to enable display side composition. This would require the individual application canvases to be copied over to the monitor 20, but enables each application image to be stored in memory at the display monitor, in case it is needed. This would enable, for example composition to be performed on the display side if the individual application canvases are stored in the refresh buffer 25 (or display store 38). Tiles would then be composed as updates and refreshed on demand. Remote composition can further reduce host side memory and display link bandwidth requirements.

Figure 6:
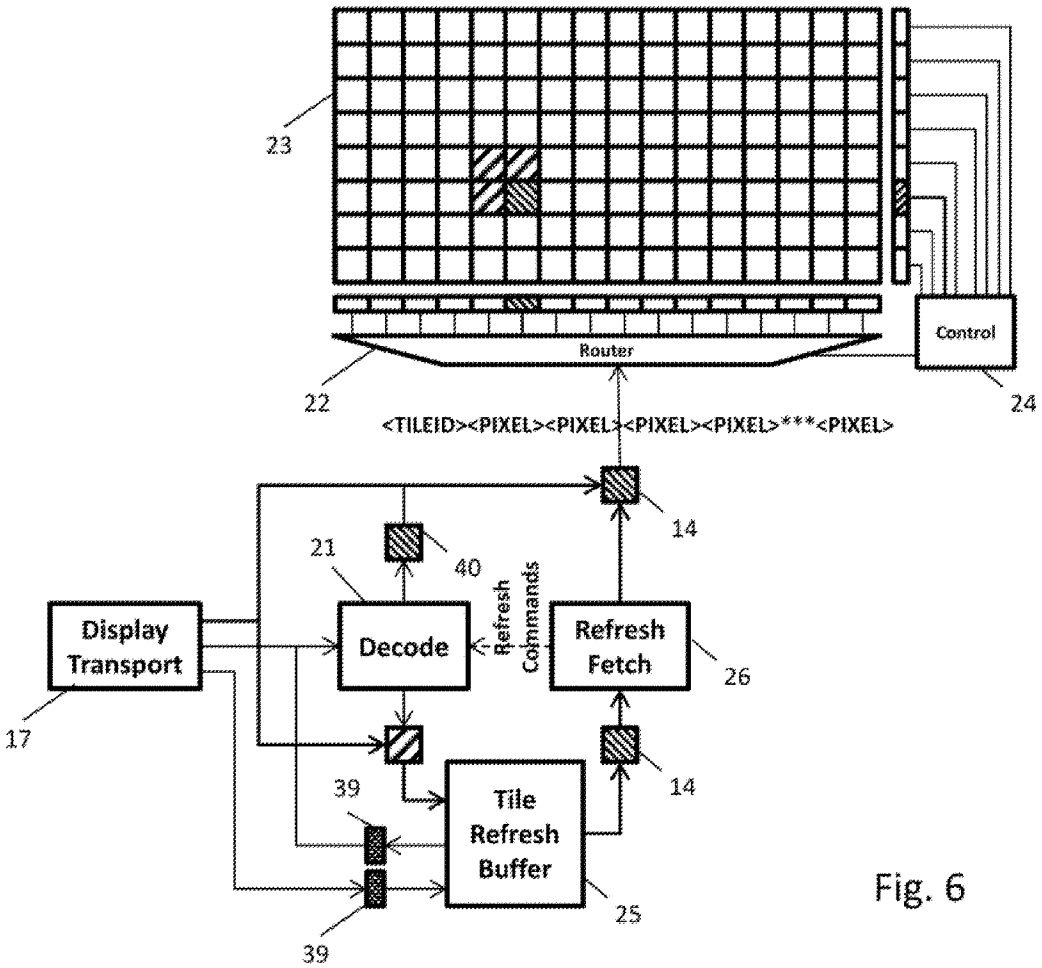
FIG. 6 shows a general schematic view of an architecture for receiving and displaying images in the display system of FIG. 2.

FIG. 6 shows the display side in more detail, from which it can be seen the composed image tiles 14 passed to the monitor router 22, which routes the composed image tiles directly to their location in the final image onto a display 23 of the monitor, under the control of a display controller 24. As explained earlier, each composed image tile includes the tile identification information, indicating where in the final image it is to be positioned, as well as pixel information indicating how each pixel is to be controlled. When the composed image tile 14 is received at the monitor from the transport mechanism, it may be sent directly to the display for presentation if it is a RAW composed image tile, or may need to be decoded by decoder 21 to produce the decoded/decompressed composed image tile 40. In either case, if the display does not have in-panel pixel memory then all the composed image tiles are also copied to the refresh buffer 25 (or display store 38) from which tiles can be fetched as needed to refresh the panel. Only one frame/refresh buffer is required as updates are written simultaneously to the display panel itself. This is a saving on the conventional system where line based updating normally requires at least two frame buffers as one must be updated while the other is presented to the display. An alternative is to copy the lines at the display rate—normally 60 fps, timed such that it does not interfere with display update/presentation. However, this is a very memory and link bandwidth intensive activity.

Alternatively, a compressed composed image tile 39 may be stored in the refresh buffer 25, as it is received, and then sent to the decoder 21 only when it is required by the tile refresh controller 26.

The tile refresh controller 26 is used to make sure that all tiles in the display 23 are refreshed at a minimum refresh rate, even if no updated composed image tiles have been received for that tile within a particular time period. The tile refresh controller 26 maintains a record of which tiles on the display 23 have been refreshed, for example by update composed image tiles being received and displayed, and makes sure that all tiles in the display 23 are refreshed periodically. If no update composed image tiles have been received, then the tile refresh controller 26 takes the last received composed image tile for that location from the refresh buffer 25 and uses that, as explained above. In this way, only tile updates need be sent over the transport mechanism and the network and the display is refreshed on a tile-by-tile basis, as needed to maintain an appropriate quality of image for the user. It will, of course, be understood, that the tile refresh controller 26 can refresh different tiles in the display 23 at different rates since different display technologies require different refresh rates. Tile based updating enables the fetch/refresh of only those tiles that have not been updated in the panel refresh period. Reduced tile/pixel refresh rates can save on power and reduce the capacity required by the last hop panel link and display transport as well as bandwidth to and from the refresh buffer 25.

It will be appreciated that although only one particular embodiment of the invention has been described in detail, various modifications and improvements can be made by a person skilled in the art without departing from the scope of the present invention.

What is claimed is:

1. A display system for displaying a final displayed image formed of a plurality of image tiles which combine to form the final displayed image, each image tile comprising a plurality of pixels, the display system comprising a plurality of application engines, an image compositor and a monitor for displaying the final displayed image, the image compositor having a plurality of inputs coupled to outputs of the plurality of application engines and configured to receive image tiles generated by the plurality of application engines, the image tiles from different application engines being received independently from each other and at independent rates, wherein each image tile forms part of a complete image, wherein the image compositor comprises a processor for combining the received image tiles into one or more combined image tiles in which the received image tiles are combined according to information indicating how the received image tiles are to be combined and located in the final displayed image, the image compositor further comprising an output for outputting each of the one or more combined image tiles together with information indicating where the one or more combined image tiles are to be located in the final displayed image, wherein the one or more combined image tiles are individually transported from the image compositor for rendering on the monitor, wherein the received one or more combined image tiles are passed to a monitor router for routing to their location in the final displayed image according to the information indicating where the one or more combined image tiles are to be located, wherein individual of the one or more combined image tiles are sent at different times to the monitor for display, so that different portions of the monitor are refreshed at different refresh rates, as the one or more combined image tiles are received from the image compositor, wherein the one or more combined image tiles that are received may update any portion of the final displayed image and the portions of the final displayed image that are refreshed are refreshed in any order, wherein a refresh rate of the monitor is independent from an update rate of the application engine that generated a respective image tile and is independent of a refresh rate of the different portions of the image using the one or more combined image tiles, wherein the received one or more combined image tiles are also passed for storage in a buffer in the monitor, the monitor comprising a tile refresh controller that is configured to maintain a record of which image tiles in the final displayed image have been refreshed, take the stored one or more combined image tiles from the buffer and pass the stored one or more combined image tiles to the monitor router for routing to its location in the final displayed image according to the information indicating where the one or more combined image tiles are to be located, so that all image tiles in the final displayed image are refreshed periodically, whereby locations in the final displayed image on the display are refreshed at different refresh rates.

2. The display system of claim 1, wherein the monitor comprises a plurality of pixels, each pixel being individually addressable and controllable, and a pixel memory for each pixel of the monitor for storing a power level for the respective pixel, wherein the pixel memories are updated according to the location of the corresponding pixel of the monitor and the refresh rate for that location of the monitor.

3. The display system of claim 1, wherein only a portion of the monitor is refreshed at each update.

4. The display system of claim 3, wherein the portion of the image that is refreshed comprises one or more image tiles, each image tile comprising a plurality of pixels.

5. The display system of claim 1, wherein the one or more combined image tiles provided by the image compositor are compressed prior to being transported to the monitor, and are decompressed prior to being displayed at the monitor.

6. A display system for displaying a final image on a monitor, the final image being formed of a plurality of image tiles which combine to form the final image, each image tile comprising a plurality of pixels, the display system comprising an image tile generator for providing updates of each of the plurality of image tiles, the image tile updates being provided independently from each other and at independent rates, and a monitor for displaying the final image, wherein the received image tile updates are passed to a monitor router for routing to their location in the final image according to information indicating where the image tile update is to be located, wherein the final image is displayed on the monitor by refreshing different portions of the monitor at different rates according to the rate at which the image tile updates are provided by the image generator, wherein the refreshed portions of the final image may be located anywhere on the monitor, wherein the image tile updates that are received may update any portion of the final image and the refreshed portions of the final image are refreshed in any order, wherein a refresh rate of the monitor is independent a refresh rate of the refreshed portions of the image using the image tile updates, wherein the received image tile updates are also passed for storage in a buffer in the monitor, the monitor comprising a tile refresh controller that is configured to maintain a record of which image tiles in the final displayed image have been refreshed, take the stored image tile updates from the buffer and pass the stored image tile update to the monitor router for routing to its location in the final displayed image according to the information indicating where the image tile update is to be located, so that all image tiles in the final displayed image are refreshed periodically, whereby locations in the final displayed image on the display are refreshed at different refresh rates.

7. The display system of claim 6, wherein the monitor comprises a plurality of pixels, each pixel being individually addressable and controllable, and a pixel memory for each pixel on the monitor for storing a power level for the respective pixel, wherein the pixel memories are updated according to the location of the corresponding pixel on the monitor and the refresh rate for that portion of the image displayed on the monitor.

8. The display system of claim 6, wherein the portions of the image that are refreshed comprise one or more image tiles, each image tile comprising a plurality of pixels.

9. The display system of claim 6, wherein the image tile updates provided by the image tile generator are compressed prior to being transported to the monitor, and are decompressed prior to being displayed at the monitor.

10. A method of displaying a final image on a monitor, the final image being formed of a plurality of image tiles which combine to form the final displayed image, each image tile comprising a plurality of pixels, the monitor comprising a plurality of pixels, each pixel being individually addressable and controllable, and a pixel memory for each pixel on the monitor for storing a power level for the respective pixel, the method comprising:

receiving an update of each of the plurality of image tiles, the image tile update comprising display information indicating where each image tile is to be located in the final image on the monitor, the image tile updates being received independently from each other and at independent rates;

determining a location of the image tile on the monitor from the information indicating where each image tile is to be located; and addressing one or more pixels displaying that image tile to control the pixel memories of the one or more pixels according to the display information to display that image tile, wherein successive image tile updates that are received may refresh any portion of the final image, whereby different portions of the final image may be refreshed at different rates, wherein the image tile updates that are received may update any portion of the final image and the portions of the final image that are refreshed are refreshed in any order, wherein a refresh rate of the monitor is independent from a refresh rate of the different portions of the image using the image tile updates, wherein the received image tile updates are also passed for storage in a buffer in the monitor, the monitor comprising a tile refresh controller that is configured to maintain a record of which image tiles in the final image have been refreshed, take the stored image tile updates from the buffer and pass the stored image tile update to the monitor router for routing to its location in the final image according to the information indicating where the image tile update is to be located, so that all image tiles in the final image are refreshed periodically, whereby locations in the final image on the display are refreshed at different refresh rates.

11. The method of claim 10, wherein the pixel memories are updated according to the location of the corresponding pixel on the monitor and the refresh rate for that portion of the final image displayed on the monitor.

12. The method of claim 10, wherein the portions of the final image that are refreshed comprise one or more image tiles, each image tile comprising a plurality of pixels.

13. The method of claim 10, wherein the received image tile updates are compressed and the method further comprises decompressing the image tile updates prior to the addressing the one or more pixels.

14. The method of claim 10, further comprising:

receiving image tiles generated by a plurality of application engines; and combining the received image tiles to produce the image tile updates according to information indicating how the received image tiles are to be combined and located in the final image.

15. The method of claim 14, wherein each of the plurality of application engines generates the image tiles at a rate depending on an application being executed by a respective application engine.

16. The method of claim 14, wherein the image tiles are received directly from the plurality of application engines by an image compositor and the image tile updates are sent directly from the image compositor to a transport mechanism for transporting the image tile updates to the monitor.

17. The method of claim 16, further comprising compressing, encrypting, and/or encoding the image tile updates prior to being transported to the monitor.

* * * * *